US010821728B2

(12) United States Patent
Lee et al.

(10) Patent No.: US 10,821,728 B2
(45) Date of Patent: Nov. 3, 2020

(54) PRINTING SYSTEM

(71) Applicant: Chien Hwa Coating Technology , Inc., Hsinchu (TW)

(72) Inventors: Wen-Hsiung Lee, Hsinchu (TW); Chun-Fei Lin, Hsinchu (TW); Shao-Ying Lu, Hsinchu (TW); Wei-Sheng Huang, Hsinchu (TW); Hsin-Kai Wang, Hsinchu (TW)

(73) Assignee: Chien Hwa Coating Technology, Inc., Hsinchu (TW)

( * ) Notice: Subject to any disclaimer, the term of this patent is extended or adjusted under 35 U.S.C. 154(b) by 0 days.

(21) Appl. No.: 16/170,057

(22) Filed: Oct. 25, 2018

(65) Prior Publication Data

US 2020/0108602 A1 Apr. 9, 2020

(30) Foreign Application Priority Data

Oct. 5, 2018 (TW) ..... 107213568 U

(51) Int. Cl.

| | |
|---|---|
| ***B41J 29/38*** | (2006.01) |
| ***B41J 2/045*** | (2006.01) |
| ***B41J 2/335*** | (2006.01) |
| ***B41J 2/36*** | (2006.01) |

(52) U.S. Cl.
CPC ..... *B41J 2/04588* (2013.01); *B41J 2/3355* (2013.01); *B41J 2/36* (2013.01)

(58) Field of Classification Search
CPC ..... B41J 2/04506; B41J 2/04515
USPC ..... 347/57
See application file for complete search history.

(56) References Cited

U.S. PATENT DOCUMENTS 5,936,644 A * 8/1999 Ono ..... B41J 2/04506 347/10
8,444,254 B2 * 5/2013 Han ..... B41J 2/04515 347/57

* cited by examiner

*Primary Examiner* — Lam S Nguyen
(74) *Attorney, Agent, or Firm* — Rosenberg, Klein & Lee

(57) ABSTRACT

A printing system includes a controller and a thermal printing head including multiple driving elements and an integrated transmission control interface. The thermal printing head is coupled to the controller. The driving elements are configured to print. The integrated transmission control interface coupled to the controller and driving elements is configured to receive from the controller at least one of a compensation data, a printing data, a clock signal, a data signal, a latch signal or a start-heating signal, and send to driving elements the at least one of the compensation data, the printing data, the clock signal, the data signal, the latch signal or the start-heating signal.

6 Claims, 7 Drawing Sheets

160

PRINTING SYSTEM

RELATED APPLICATIONS

This application claims priority to Taiwan Application Serial Number 107213568, filed Oct. 5, 2018, which is herein incorporated by reference.

BACKGROUND

Technical Field

The disclosure relates to a printing system, particularly to a thermal printing system.

Description of Related Art

Conventional, there are lots of cables and connectors between a thermal printing head (TPH) and a controller, resulting in high cost and low stability and reliability.

Therefore, it is an important issue that how to reduce cables between the thermal printing head and the controller and to improve stability and reliability.

SUMMARY

One aspect of the present disclosure is a printing system including a controller and a thermal printing head including multiple driving elements and an integrated transmission control interface. The thermal printing head is coupled to the controller. The driving elements are configured to print. The integrated transmission control interface coupled to the controller and driving elements is configured to receive from the controller at least one of a compensation data, a printing data, a clock signal, a data signal, a latch signal or a start-heating signal, and send to driving elements the at least one of the compensation data, the printing data, the clock signal, the data signal, the latch signal or the start-heating signal.

DETAILED DESCRIPTION

The following embodiments are disclosed with accompanying diagrams for detailed description. For illustration clarity, many details of practice are explained in the following descriptions. However, it should be understood that these details of practice do not intend to limit the present disclosure. That is, these details of practice are not necessary in parts of embodiments of the present disclosure. Furthermore, for simplifying the diagrams, some of the conventional structures and elements are shown with schematic illustrations.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Figure 1A:
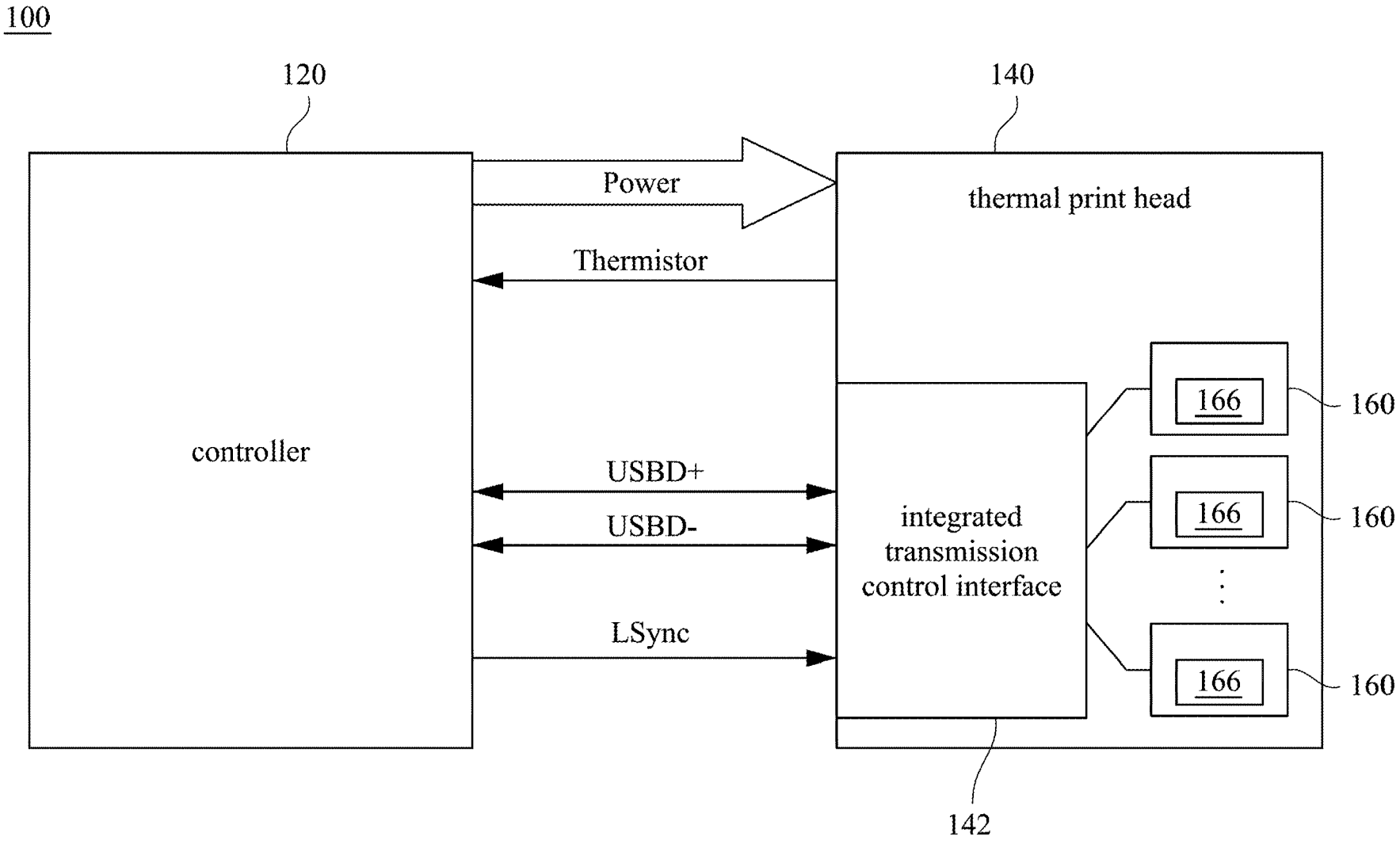
FIG. 1A is a schematic diagram illustrating of a thermal printing system in accordance with some embodiments of the disclosure.

Please refer to FIG. 1A. FIG. 1A is a schematic diagram illustrating of a thermal printing system 100 in accordance with some embodiments of the disclosure. As shown in FIG. 1A, the thermal printing system 100 includes a controller 120 and a thermal printing head 140. The thermal printing head 140 includes an integrated transmission control interface 142 and multiple driving elements 160. The driving element 160 includes a delay latch array 166. In structure, the controller 120 is electrically coupled to the thermal printing head 140. The integrated transmission control interface 142 is electrically coupled to the controller 120 and multiple driving elements 160.

In operation, the integrated transmission control interface 142 is configured to transmit to the driving element 160 control signals including a clock signal, a data signal, a latch signal and a compensation signal, etc. The driving element 160 is configured to heat and print according to the control signals. The delay latch array 166 is configured to store the compensation signals and output the control signals that are compensated.

Specifically, there are a power transmission line Power, a thermistor transmission line Thermistor and other control signal transmission lines between the controller 120 and the thermal printing head 140. And the integrated transmission control interface 142 is configured to integrate transmission lines and interfaces between the controller 120 and the thermal printing head 140. In some embodiments, the integrated transmission control interface 142 includes a field-programmable gate array (FPGA). In some other embodiments, the integrated transmission control interface 142 includes an application-specific integrated circuit (ASIC).

In some embodiments, to print a dot, the data of 8 bpp needs to be converted into 256 bpp, so that the heating resistor is able to be heated at certain tone level. In convention, after a controller performs the data conversion of 8 bpp to 256 bpp, the controller outputs the 256 bpp data (by 256 heating cycles at 1 bpp per cycle, for instance) to a thermal printing head. In the present embodiment, the controller 120 directly outputs the data of 8 bpp to the thermal printing head 140. The integrated transmission control interface 142 of the thermal printing head 140 is able to perform the data conversion of 8 bpp to 256 bpp.

In addition, in some embodiments, the integrated transmission control interface 142 includes a universal serial bus (USB), but not limited to the present disclosure. That is, the integrated transmission control interface 142 may include differential signal pins USB+, USB− of USB 2.0 or USB 3.0, and the differential signal pins USB+, USB− are configured to transmit the compensation data or the printing data. The integrated transmission control interface 142 may also include a synchronous printing pin LSync. The synchronous printing pin LSync integrates the transmission lines of control signals such as the clock signal, the data signal, the latch signal and/or a start-heating signal. The synchronous printing pin LSync is configured to print synchronously with mechanical motion.

In other words, the integrated transmission control interface 142 collects multiple transmission lines. The integrated transmission control interface 142 is configured to receive command & data from the controller 120 then converts to corresponding control signals including the clock signal, data signal (e.g., printing data, heating time), and output multiple printing commands to the corresponding driving element 160 respectively according to control signals to print.

As a result, it is able to reduce the number of pins of the controller 120 and the number of wires between the controller 120 and the thermal printing head 140 by the integrated transmission control interface 142 in the thermal printing head 140. Accordingly, it is able to cost down, reduce complexity of circuits and improve transmission efficiency.

Figure 2:
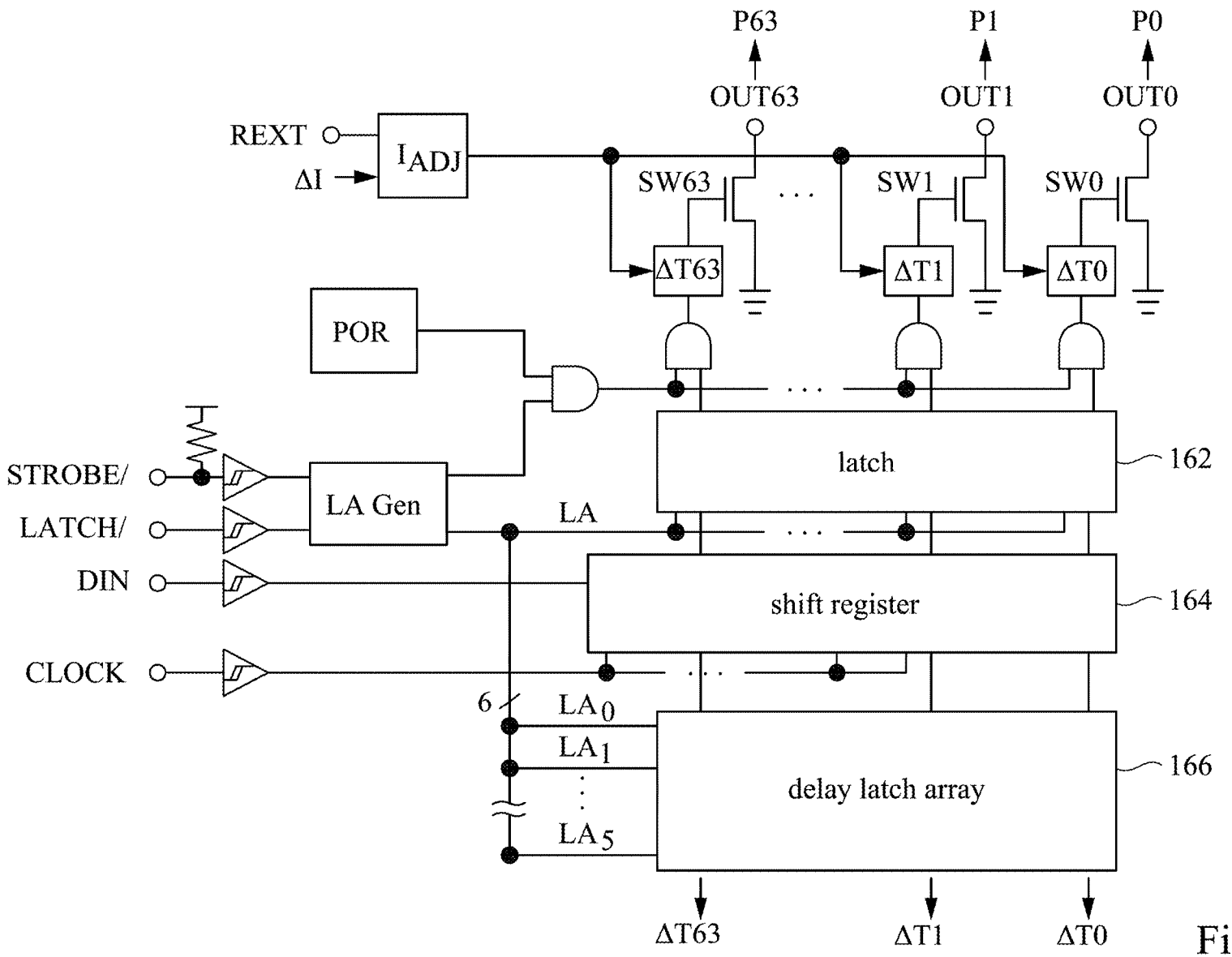
FIG. 2 is a schematic diagram illustrating of a driving element in accordance with some embodiments of the disclosure.

About the detailed description of the driving element 160 in the thermal printing head 140, please refer to FIG. 2. FIG. 2 is a schematic diagram illustrating of the driving element 160 in the thermal printing head 140 in accordance with some embodiments of the disclosure. In operation, the driving element 160 is configured to output printing commands to the corresponding heating resistors P0~P63 through the output terminals OUT0~OUT63 respectively according to control signals to print. Specifically, the driving element 160 is configured to set the compensation value according to the data signal DIN, the clock signal CLOCK, the start-heating signal STROBE and the latch signal LATCH to generate the compensation value of heating time corresponding to each heating resistor.

A shift register 164 in the driving element 160 is configured to receive the printing data in sequence according to the data signal DIN and the clock signal CLOCK. A latch 162 in the driving element 160 is configured to latch the printing data in a buffer according to the latch signal LATCH. The delay latch array 166 in the driving element 160 is configured to store the compensation signal and output the compensation signal. The pixel switches SW0~SW63 are configured to conduct or cut off according to the start-heating signal STROBE, the printing data and the compensation signal.

In some embodiments, the driving element 160 includes a latch signal generator LA Gen. The latch signal generator LA Gen is configured to set the compensation value according to the start-heating signal STROBE and the latch signal LATCH to generate the latch signal LA and/or the delay latch signal LA0~LA5. In some other embodiments, the driving element 160 further includes power on reset circuit POR that is configured to reset the internals of the driving element 160 at startup. In some other embodiments, the driving element 160 further includes an external resistor REXT that is configured to adjust a maximum value of the compensation value of the heating time of each heating resistor.

Figure 3:
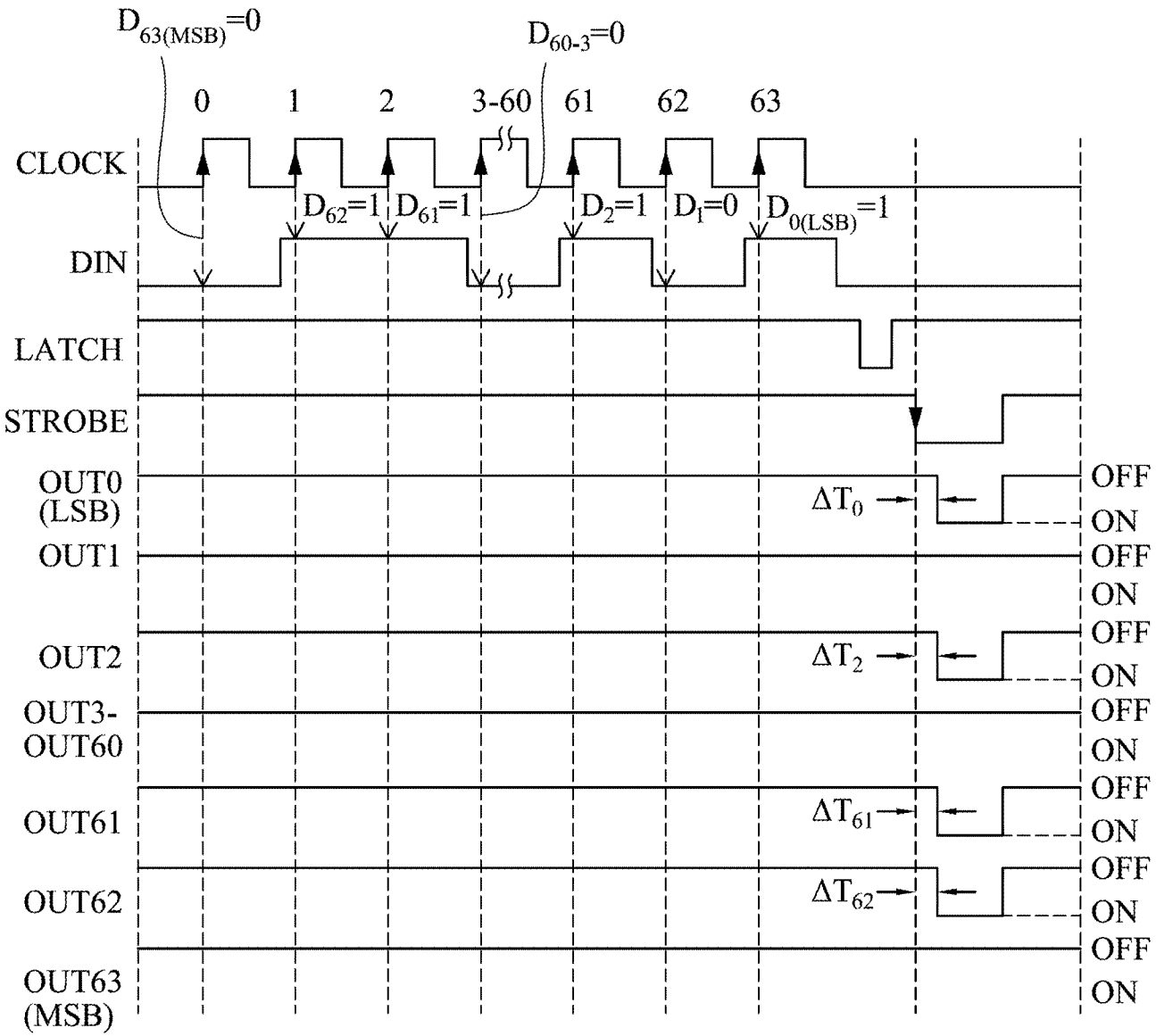
FIG. 3 is a timing diagram illustrating of control signals in accordance with some embodiments of the disclosure.

Specifically, please refer to FIG. 2 and FIG. 3 together. FIG. 3 is a timing diagram illustrating of control signals in accordance with some embodiments of the disclosure. As shown in FIG. 3, the data signal DIN is a serial data of the printing data Dn. The printing data Dn is 0 or 1. 1 represents the point to be printed, and 0 represents the point not to be printed. In some embodiments, the integrated transmission control interface 142 inputs the data signal DIN to the driving element 160 from left to right. The shift register 164 receives one printing data Dn of the data signal DIN as the clock signal CLOCK rises, and copies the printing data Dn of the previous data signal DIN to the next bit.

In other words, after the times of the clock signal CLOCK rising are as same as the number of the pixels (the heating resistors P0~P63), the shift register 164 receives the entire line of printing data Dn (e.g., the printing data D0~D63 shown in FIG. 3). For example, in some embodiments, the shift register 164 is 64 bits, and the driving element 160 includes 64 heating resistors P0~P63. Therefore, after the clock signal CLOCK rises 64 times, the shift register 164 receives 64 points, one line of the printing data Dn. It should be noted that, the values above are merely by example in some possible embodiments for the convenience of discussion, and not intended to limit the present disclosure.

Figure 1B:
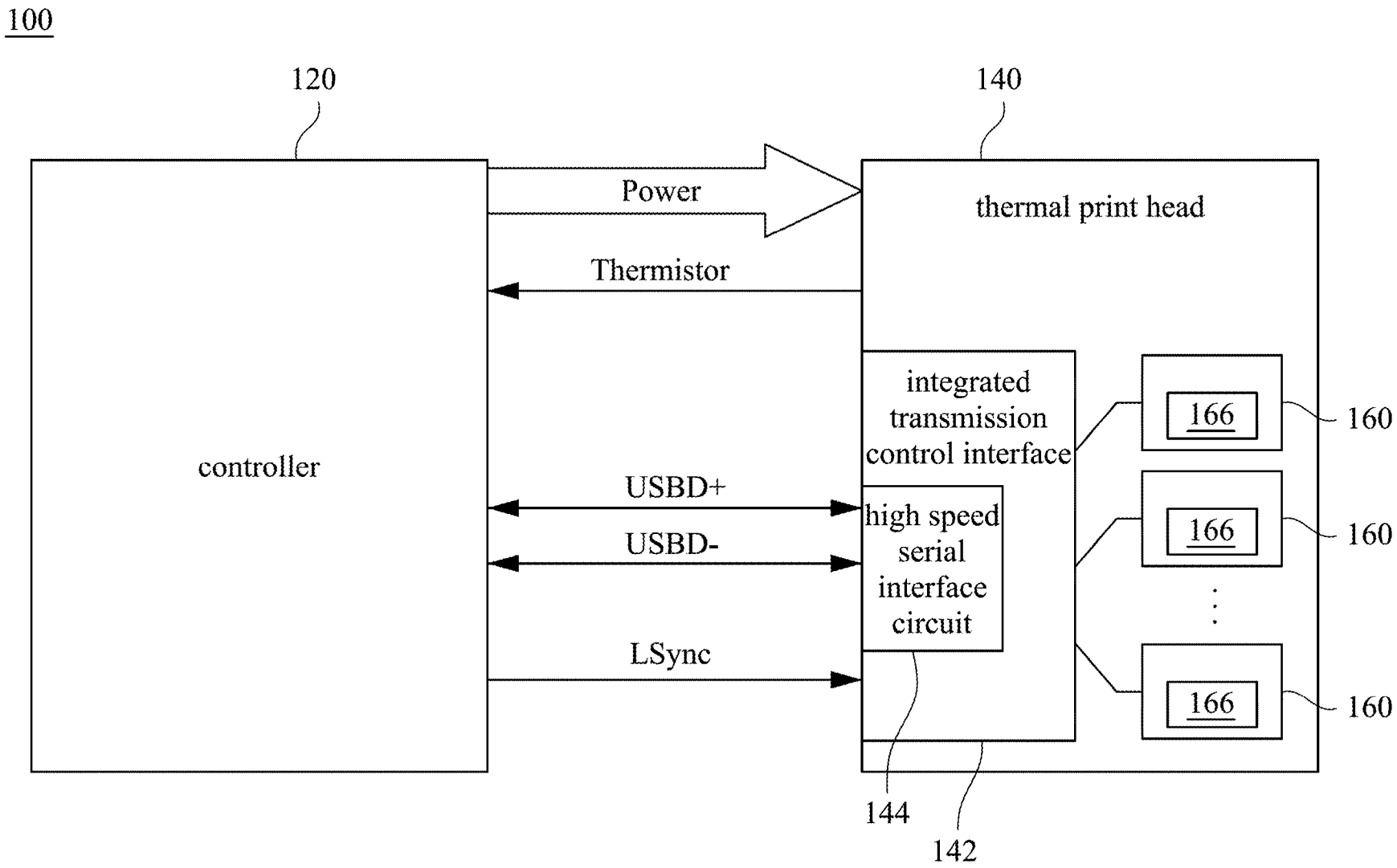
FIG. 1B is a schematic diagram illustrating of a thermal printing system in accordance with some embodiments of the disclosure.

Please refer to FIG. 1B together. FIG. 1B is a schematic diagram illustrating of a thermal printing system 100 in accordance with some embodiments of the disclosure. In the embodiment as shown in FIG. 1B, the integrated transmission control interface 142 and the controller 120 of the thermal printing system 100 are connected by communication. The integrated transmission control interface 140 receives from the controller 120 at least one of the compensation signal (e.g., the delay latch signal LA0~LA5 stored in the delay register 166 shown in FIG. 2), the printing data (e.g., the printing data D0~D63 shown in FIG. 3), the clock signal (e.g., the clock signal CLOCK shown in FIG. 2), the data signal (e.g., the data signal DIN shown in FIG. 2), the latch signal (e.g., the latch signal LATCH shown in FIG. 2) and the start-heating signal.

In the embodiment shown in FIG. 1B, the integrated transmission control interface 142 includes a high speed serial interface circuit 144. In practical applications, the high speed serial interface circuit 144 may be realized by a universal serial bus (USB). The high speed serial interface circuit 144 is configured to receive from the controller 120 the compensation data (e.g., the delay latch signals LA0~LA5 stored in the delay latch array 166 shown in FIG. 2) and/or the printing data (e.g., the printing data D0~D63 shown in FIG. 3) in the format of command/data then decode at the high speed serial interface circuit 144 accordingly.

Since the thermal printing head 140 prints the image of the entire line once, the thermal printing head 140 needs to use the entire line of the printing data at the same time. Conventionally, 2 to 6 inch thermal printing head needs 5 to 30 printing cables. And the larger the size of the thermal printing head is, more cables are required to be assigned between the conventional thermal printing head and the controller, so that it needs to occupy more space, costs higher and reduces the reliability. In the embodiment shown in FIG. 1B, the high speed serial interface circuit 144 is able to transmit the entire line of the printing data in serial at high speed. As shown in FIG. 1B, it is able to transmit command and data from the controller 120 then converts to corresponding delay latch signals (LA0~LA5) and/or the printing data (e.g., the printing data D0~D63 shown in FIG. 3) by a pair of differential signal lines (e.g., the differential signal pins USB+, USB− shown in FIG. 1B).

Next, please refer to FIG. 3. The latch signal LATCH is configured to control and latch the printing data Dn. When the latch signal LATCH is at low level, the shift register 164 sends the entire line of the printing data Dn to the latch 162. The latch 162 stores the printing data Dn in the buffer. After the latch signal LATCH is turned to high level, the start-heating signal STROBE is turned to low level to control the heating time. When the start-heating signal STROBE is at low level, the pixel switches SW0~SW63 are determined whether conduct according to the corresponding printing data Dn. In other words, the pixel switches SW0~SW63 whether to conduct is according to whether the printing data Dn corresponding to pixels of the pixel switches SW0~SW63 is 1, so that the printing commands are outputted to the heating resistors P0~P63 through the output terminals OUT0~OUT63 to heat and print. When the start-heating signal STROBE is turned to high level, all pixel switches SW0~SW63 are cut off.

For example, as shown in FIG. 3, the printing data Dn with clock sequence of 0 corresponds to the printing command Off of the output terminal OUT63, and the printing data Dn with clock sequence of 1 corresponds to the printing command On of the output terminal OUT62. And so on, the printing data Dn with clock sequence of 63 corresponds to the printing command On of the output terminal OUT0. In other words, the data signals DIN are 0, 1, 1 . . . 1, 0, 1 in order, therefore, the signals corresponding to the output terminals OUT0~OUT63 are On, Off, On . . . On, On, Off in order. As a result, the pixel switches SW0~SW63 are determined whether conduct according to the corresponding printing data Dn of pixels (heating resistors P0~P63), so that the driving element 160 is able to print.

However, at the same voltage and the same heating time, the different resistance values of the pixels will result in different power consumption, so that the printing density is uneven. Furthermore, at the same voltage, the larger the resistance value is, the smaller the power consumption is, so that the printing density is lighter. Therefore, in order to improve the uniformity of printing quality, different resistors needs to have the same power consumption. In other words, at the same voltage, the heating time should be adjusted according to the difference of the resistance values.

Accordingly, the printing command further includes the heating time and the delay signal corresponding to the heating time. The total conducting times of the pixel switches SW0~SW63 are determined according to the corresponding heating times respectively, and the timings of starting to conduct are determined according to the corresponding delay signals respectively. In other words, the pixel switches SW0~SW63 are configured to output control signals to the heating resistors P0~P63 according to the corresponding heating times and delay signals of pixels.

Specifically, the delay latch array 166 is configured to store and output the compensation signals including delay signals $\Delta T_0$~$\Delta T_{63}$. The heating times corresponding to multiple pixels are calculated by a calculator according to multiple corresponding resistance values and the largest resistance value respectively during the manufacture of the thermal printing head. And the delay signals $\Delta T_0$~$T_{63}$ are calculated respectively by the calculator according to multiple heating times. In some embodiments, the calculator may be a jig and/or application software. The driving element 160 in the thermal printing head 140 is configured to adjust the conducting times of the heating resistors P0~P63 corresponding to different pixels respectively according to the heating times and the delay signals $\Delta T_0$~$\Delta T_{63}$.

Figure 4:
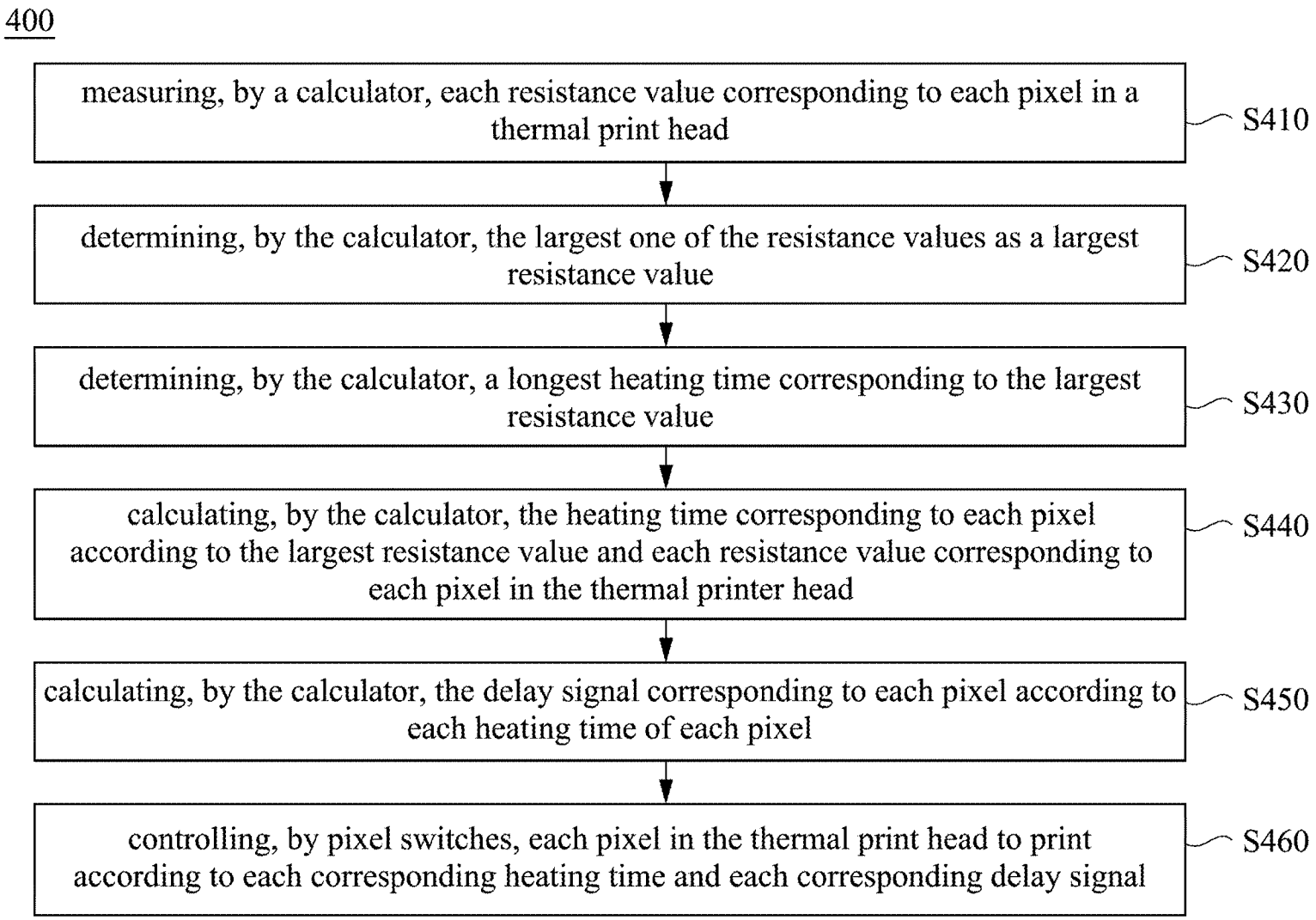
FIG. 4 is a flowchart of a printing method illustrated in accordance with some embodiments of the disclosure.

For the convenience and clarity of explanation, the operation above will be disclosed with accompanying schematic diagrams for detailed description. Please refer to FIG. 4. FIG. 4 is a flowchart of a printing method 400 illustrated in accordance with some embodiments of the disclosure. As shown in FIG. 4, the printing method 400 includes operations S410, S420, S430, S440, S450 and S460.

Firstly, in the operation S410, measuring, by a calculator, each resistance value corresponding to each pixel in a thermal printing head 140.

Next, in the operation S420, determining, by the calculator, the largest one of the resistance values as a largest resistance value.

Next, in the operation S430, determining, by the calculator, a longest heating time corresponding to the largest resistance value.

Next, in the operation S440, calculating, by the calculator, the heating time corresponding to each pixel according to the largest resistance value and each resistance value corresponding to each pixel in the thermal printing head 140. For example, the calculator calculates the heating time of each pixel according to the following formula:

$$\frac{V^2}{R_m} \times t_m = \frac{V^2}{R_n} \times t_n,\ t_n = \frac{R_n}{R_m} \times t_m$$

$R_n$ is the resistance value of the nth pixel, $R_m$ is the largest resistance value Rm among the resistance values of n pixels. $t_n$ is the heating time of the nth pixel. $t_m$ is the heating time of the pixel with the largest resistance value. In other words, the heating time of the pixel with the largest resistance value Rm is the longest heating time Tm.

It should be noted that, the formula above is merely by example in some possible embodiments for the convenience of discussion, and not intended to limit the present disclosure. In addition, in some other embodiments, the calculator is able to adjust the heating times of pixels respectively according to the temperature or other factors of pixels in the thermal printing head 140.

Figure 5:
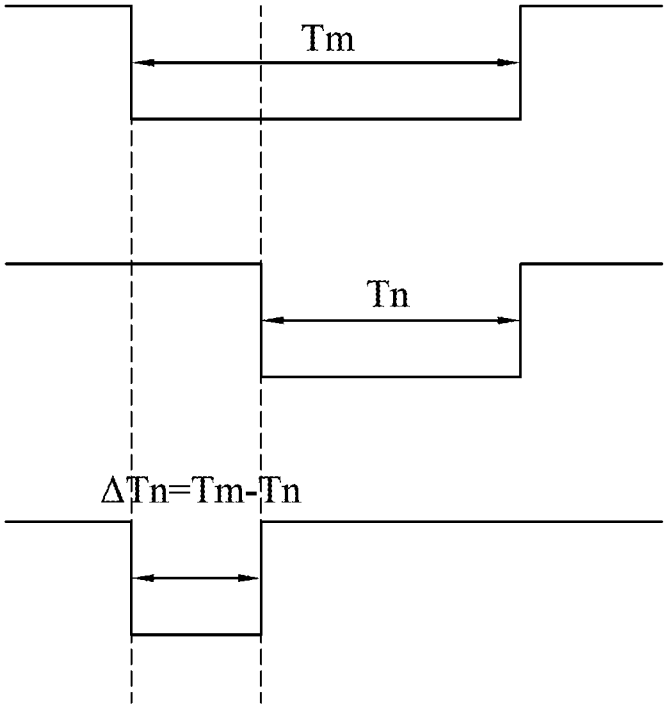
FIG. 5 is a schematic diagram illustrating of the length of control signals in accordance with some embodiments of the disclosure.

Next, in the operation S450, calculating, by the calculator, the delay signals corresponding to each pixel according to each heating time of each pixel. For example, as shown in FIG. 5, Tm is the longest heating time corresponding to the largest resistance value Rm. Tn is the heating time corresponding to the nth resistance value. The delay signal $\Delta T_n$ corresponding to the nth resistor is Tm-Tn.

Specifically, the compensation data including delay signal is configured to adjust the printing command through the delay latch signal LA0~LA5 of the delay latch array 166. In some embodiments, as shown in FIG. 2, each pixel corresponds to one of 6-step delay latch signal LA0~LA5. For example, as the time of the longest delay signal is about 4 μs, the 6-step delay latch array may control $2^6$=64 segments, so that each segment may reach an accuracy of about 4 μs/64=62.5 ns. For another example, as the longest time of the delay signal is about 2 μs, the 6-step delay latch array may control $2^6$=64 segments, so that each segment may reach an accuracy of about 2 μs/64=31.25 ns. It should be noted that, the values above are merely by example in some possible embodiments for the convenience of discussion, and not intended to limit the present disclosure.

Figure 6:
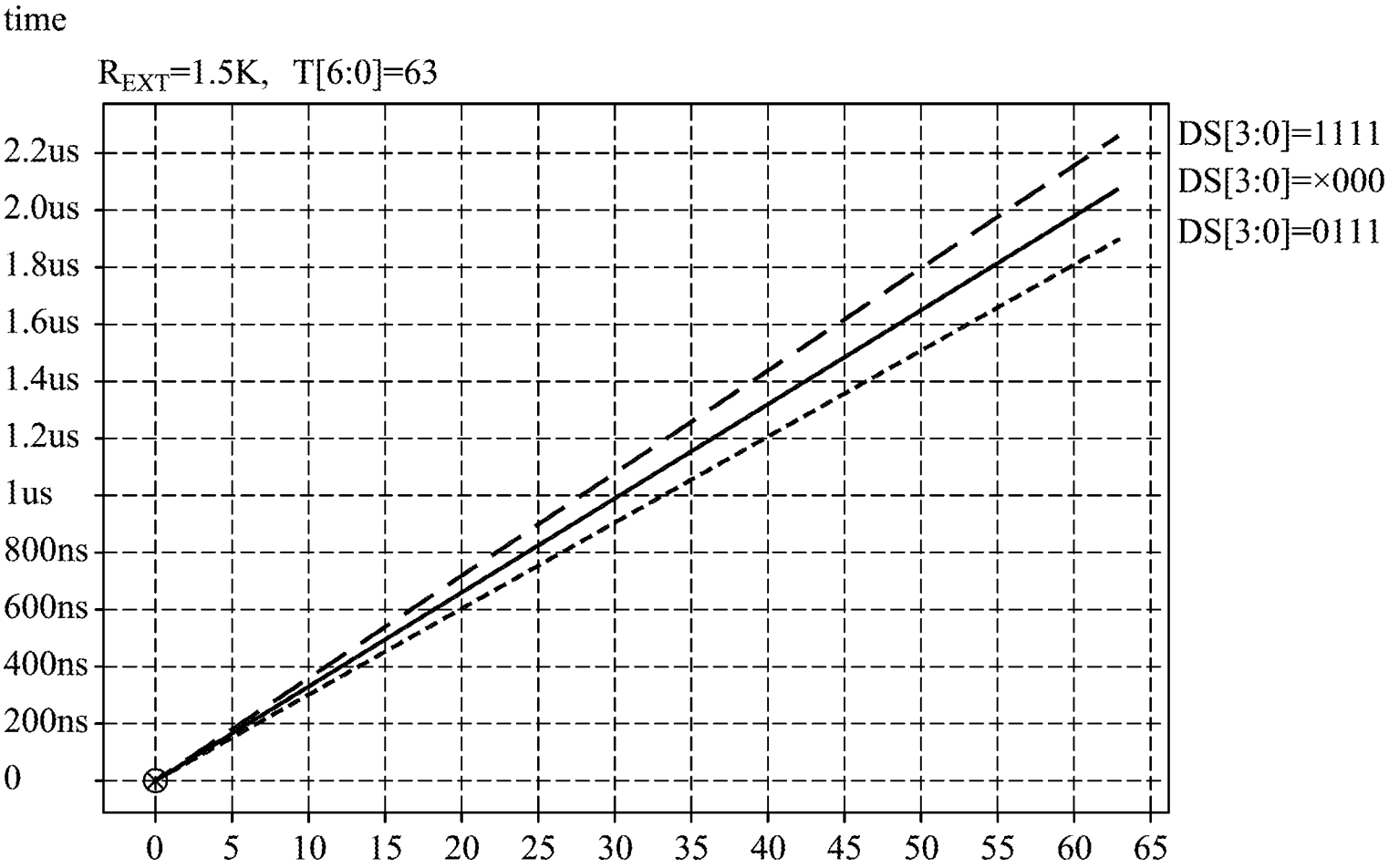
FIG. 6 is a schematic diagram illustrating of compensation signals in accordance with some embodiments of the disclosure.

Furthermore, in some other embodiments, the driving element 160 is further configured to obtain the same actual time of the delay signal by setting the delay skew. The actual times of the delay signals of the driving element 160 will be different due to the process variation. Therefore, before combines the heater and the cables, measuring the actual times of the delay signals by providing signals with the longest delay time to obtain the delay skews DS, as shown in FIG. 6. Specifically, the external resistor REXT shown in FIG. 2 is configured to adjust the delay skew DS.

For example, the set time of the delay signal is about 4 μs, and the actual measured time of the delay signal is about 3.8 μs, so that the difference of 0.2 μs due to process variation is able to be compensated by adjusting the delay skew DS. As a result, the driving element 160 adjusts the times of the delay signals of pixels respectively according to the longest delay time, so that the different driving elements 160 may obtain the same actual time of the delay signals.

The part of operations above may be realized by the calculator (e.g., jig and/or application software) during the manufacture of the thermal printing head 140. And the compensation data calculated according to each thermal printing head 140 may be stored in a non-volatile memory in the thermal printing head 140, or be stored in a database that is able to send to the users. And then, the compensation data is loaded into the delay latch array 166.

Finally, in the operation of S460, controlling, by pixel switches SW0~SW63, each pixel in the thermal printing head 140 to print according to each corresponding heating time and each corresponding delay signal. As shown in FIG. 3, there are multiple delay signals $\Delta T_0 \sim T_{63}$ between the start-heating signal STROBE at low level and the signals of the output terminals OUT0~OUT63 at low level. In other words, there are different time delays of the timings of pixel switches SW0~SW63 starting to conduct according to the corresponding delay signals of pixels. And all pixel switches SW0~SW63 stop conducting at the same time. That is, all the heating resistors P0~P63 stop heating and printing at the same time.

In addition, in some other embodiments, each pixel switch SW0~SW63 is able to start to conduct at the same time, and stops printing and conducting according to the delay signal corresponding to each pixel. As a result, by different time lengths of the delay signals $\Delta T_0 \sim \Delta T_{63}$, the total length of time for each pixel in the thermal printing head 140 to be heated and printed is different, so as to compensate different resistors to achieve the same power consumption and to improve the uniformity of printing quality.

Specifically, when the thermal printing system 100 powers up, the compensation data is read from the internal memory in the thermal printing head 140 to the delay latch array 166, or the compensation data is read from the corresponding database (the remote computer, server etc.) of the thermal printing head 140 by the controller 120. Next, the corresponding compensation data is programed to the delay latch array 166 of the driving element 160 according to the specifications of the thermal printing head 140. Then, the corresponding pixel switches SW0~SW63 of the driving element 160 in the thermal printing head 140 are controlled to start to conduct according to the corresponding heating times and the corresponding delay signals in the compensation data to heat the resistor P0~P63 to print.

The above printing method 400 is described in accompanying with the embodiments shown in FIGS. 1A, 1B, 2~6, but not limited thereto. Various alterations and modifications may be performed on the disclosure by those of ordinary skilled in the art without departing from the principle and spirit of the disclosure. In the foregoing, exemplary operations are included. However, these operations do not need to be performed sequentially. The operations mentioned in the embodiment may be adjusted according to actual needs unless the order is specifically stated, and may even be performed simultaneously or partially simultaneously.

Furthermore, each of the above embodiments may be implemented by various types of digital or analog circuits or by different integrated circuit chips. Individual components may also be integrated into a single control chip. Various control circuits may also be implemented by various processors or other integrated circuit chips. The above is only an example, and it should not limit the present disclosure.

In summary, in various embodiments of the present disclosure, the number of the pins of the controller 120 and the number of cables between the controller 120 and thermal printing head 140 may be reduced by the integrated transmission control interface 142. Accordingly, it may cost down, reduce complexity of circuits and improve transmission efficiency, stability and reliability.

Although specific embodiments of the disclosure have been disclosed with reference to the above embodiments, these embodiments are not intended to limit the disclosure. Various alterations and modifications may be performed on the disclosure by those of ordinary skills in the art without departing from the principle and spirit of the disclosure. Thus, the protective scope of the disclosure shall be defined by the appended claims.

What is claimed is:

1. A printing system, comprising:

a controller; and a thermal printing head coupled to the controller, the thermal printing head comprising:

a plurality of driving elements configured to print; and an integrated transmission control interface directly coupled to the controller and driving elements and configured to receive from the controller at least one of compensation data, a printing data, a clock signal, a data signal, a latch signal or a start-heating signal and send to the plurality of driving elements the at least one of the compensation data, the printing data, the clock signal, the data signal, the latch signal or the start-heating signal to generate a printing command, wherein each of the driving elements further comprising:

a shift register configured to receive the printing data in sequence according to the data signal and the clock signal;

a latch coupled to the shift register configured to latch the printing data from the shift register in a buffer according to the latch signal; and a delay latch array coupled to the shift register configured to store the compensation data and output the compensation data including delay signals, wherein the delay signals are configured to adjust the printing command.

2. The printing system of claim 1, wherein the integrated transmission control interface comprises a high speed serial interface circuit, the high speed serial interface circuit is configured to receive from the controller at least one of the compensation data and the printing data.

3. The printing system of claim 1, wherein the integrated transmission control interface is further configured to convert the printing data into a printing command and send the printing command to the driving elements.

4. The printing system of claim 1, wherein the integrated transmission control interface comprises a field-programmable gate array or an application-specific integrated circuit.

5. The printing system of claim 1, wherein the compensation data or the printing data is transmitted through two differential signal pins of the integrated transmission control interface.

6. The printing system of claim 1, wherein the clock signal, the data signal, the latch signal or the start-heating signal is transmitted through a synchronous printing pin of the integrated transmission control interface.

* * * * *